US012084852B2

(12) United States Patent
Bingler et al.

(10) Patent No.: US 12,084,852 B2
(45) Date of Patent: Sep. 10, 2024

(54) WOOD TIMBER FRAMING CONNECTION JOINT

(71) Applicant: Shibusa Systems LLC, New Orleans, LA (US)

(72) Inventors: Steven Bingler, New Orleans, LA (US); Michael Gwynn, New Orleans, LA (US)

(73) Assignee: Shibusa Systems LLC, New Orleans, LA (US)

( * ) Notice: Subject to any disclaimer, the term of this patent is extended or adjusted under 35 U.S.C. 154(b) by 1001 days.

(21) Appl. No.: 17/067,321

(22) Filed: Oct. 9, 2020

(65) Prior Publication Data

US 2022/0112708 A1 Apr. 14, 2022

(51) Int. Cl.
*E04B 1/26* (2006.01)

(52) U.S. Cl.
CPC ..... *E04B 1/2604* (2013.01); *E04B 2001/262* (2013.01); *E04B 2001/2636* (2013.01); *E04B 2001/266* (2013.01); *E04B 2001/2692* (2013.01)

(58) Field of Classification Search
CPC ..... E04B 1/2604; E04B 2001/262; E04B 2001/2636; E04B 2001/266; E04B 2001/2692; E04B 2001/2684
See application file for complete search history.

(56) References Cited

U.S. PATENT DOCUMENTS 4,863,305 A * 9/1989 Schold ..... E04B 1/2604 403/171
5,044,137 A * 9/1991 Shigeru ..... E04B 1/2604 52/646
5,239,803 A * 8/1993 Shannon ..... A63H 33/08 52/645
5,469,678 A * 11/1995 Zamerovsky ..... E04C 3/42 403/231
5,832,689 A * 11/1998 Curll ..... E04B 1/2604 403/219
2011/0280649 A1* 11/2011 Dewson ..... E04B 1/26 403/171

(Continued)

FOREIGN PATENT DOCUMENTS

CA 2703401 A1 * 11/2011 ..... E04B 1/26
CN 107313609 A * 11/2017 ..... E04B 1/2604

(Continued)

*Primary Examiner* — Babajide A Demuren
(74) *Attorney, Agent, or Firm* — Stradling Yocca Carlson & Rauth

(57) ABSTRACT

A wooden structural joint is provided, including a wooden rectangular base member comprising, at one end, a removed center element, a plurality of removed center edge elements, and four intact corner elements, where the removed center element and the plurality of removed center edge elements are formed from vertical and horizontal cuts into the one end of the wooden rectangular base member, a plurality of horizontal members, each horizontal member having a height and further having a tab cut therein at one edge of the horizontal member, the tab cut at a percentage of the height such that all horizontal members fit securely together when assembled within the wooden rectangular base member, and a wooden rectangular top member having one end cut similar to the wooden rectangular base member.

20 Claims, 15 Drawing Sheets

(56) References Cited

U.S. PATENT DOCUMENTS

2013/0227906 A1* 9/2013 Schold ..... E04C 3/11
52/650.1

FOREIGN PATENT DOCUMENTS

| | | | | | |
|---|---|---|---|---|---|
| CN | 108708460 | A | * | 10/2018 | ..... E04B 1/2604 |
| CN | 110130496 | A | * | 8/2019 | ..... E04B 1/26 |
| CN | 116084738 | A | * | 5/2023 | |
| DE | 102006012897 | A1 | * | 9/2007 | ..... A47C 19/021 |
| DE | 202009012789 | U1 | * | 1/2010 | ..... E04B 1/2604 |
| FR | 2588301 | A | * | 4/1987 | ..... E04B 1/2604 |

* cited by examiner

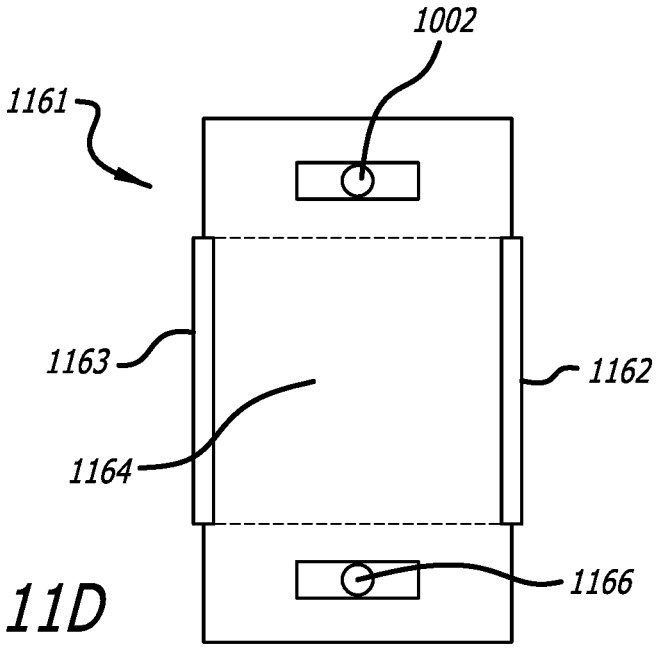
FIG. 11D
FIG. 11E
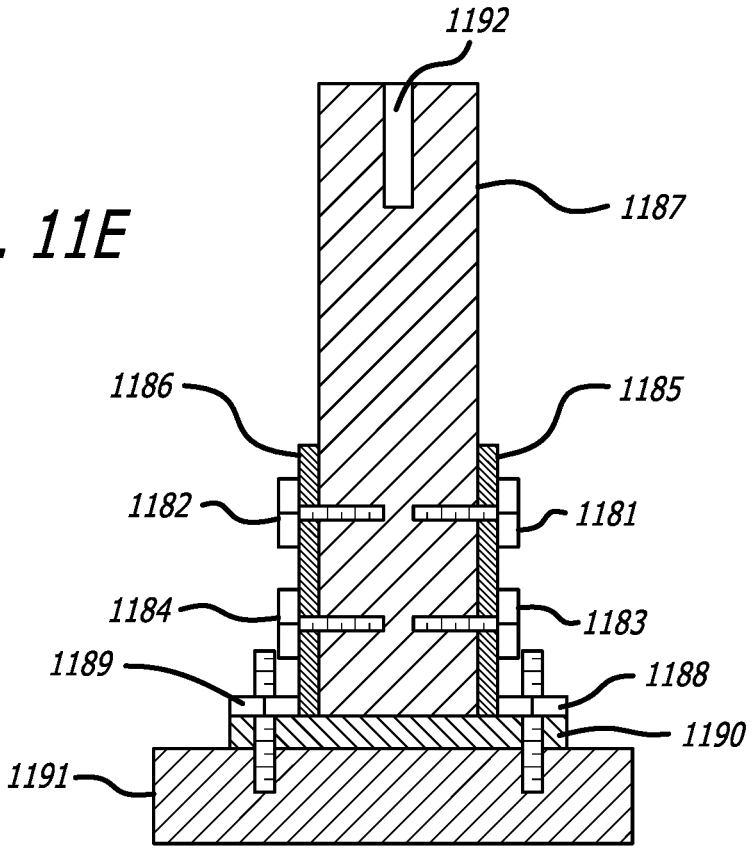

WOOD TIMBER FRAMING CONNECTION JOINT

BACKGROUND OF THE INVENTION

Field of the Invention

The present invention relates generally to the field of building construction, and more specifically to wood timber framing and joints employed in the construction of buildings.

Description of the Related Art

Wood timber construction of buildings and building framing presents a number of advantages, including environmental advantages. However, due to the variations in density, dimensions, and overall quality between different wood samples, connections between framing components can pose challenges. Timber that is even slightly irregular can cause structural and/or fit issues, and such issues are frequently not discovered until the framing is being installed.

Other types of framing elements are of course employed, including metal, composite materials, and so forth, but those framing elements are not as environmentally friendly as the use of timber, and generally cost more because of the additional labor required for installation.

One challenge with most timber post and beam building solutions is the design of the connections between columns and beams, sometimes referred to as framing connections. Framing connection challenges stem from the need for the connections to resist vertical forces of gravity as well as moment (lateral) forces from wind, earthquakes and other horizontal stresses. Most joints designed to resist these multi-lateral stresses include variously shaped steel fins or plates held in place by steel bolts. Such steel materials are produced using non-renewable resources, which is generally economically undesirable or less desirable than other materials. In addition, the installation of these connections is often labor intensive, requiring multiple trades. Such installation can be cost prohibitive for use in many environmentally friendly buildings.

Another challenge with currently available designs is the construction of framing Traditional framing systems are built from the ground up in a serial manner. On site personnel pours a foundation, may secure base plates or a sill plate to the foundation, and may secure framing members to the base plate/sill plate and lock them into place (e.g., stick framing 16 inch centers). Once the first level is completed, on site personnel may secure second level framing members to the first level to create the next floor, and so on. Personnel may manually modify framing members and subsequent sheathing in the field, causing variances in framing and structure.

This serial method of framing is not an integrated system with the foundation, but rather a "build and cut" custom system on site for construction. Principal personnel order framing members with the intent of custom cutting the members on site. This process requires substantial on-site modifications; and consequently can create increased waste, increased cycle time, and safety concerns due to on-site use of power tools. Modifications in an uncontrolled environment, i.e. on site, result in variances in dimensions that must be addressed manually in the field. Field modifications are generally undocumented, inconsistent solutions with unknown variables. As a result, specialized skills and training are required to construct the framing and sheathing of homes in this manner.

It would therefore be desirable to offer a wood timber connection system that is environmentally friendly, has a relatively low carbon footprint, and provides a level of accuracy and resistance to forces encountered that addresses the issues with previous wood framing joint designs. Further, it would be beneficial to offer a system and/or method of construction that decreases the need for making on site modifications to framing members.

SUMMARY OF THE INVENTION

Thus according to a first embodiment, there is provided a wooden structural joint comprising a wooden rectangular base member comprising a removed center element, a plurality of removed center edge elements, and four intact corner elements, where the removed center element and the at least two removed center edge elements are formed by cutting vertically and horizontally into one end of the wooden rectangular base member, a plurality of horizontal members, each horizontal member having a height and a tab cut therein at one edge of the horizontal member, the tab cut at a percentage of the height such that all horizontal members fit together securely when assembled within the wooden rectangular base member, and a wooden rectangular top member having one end cut similar to the wooden rectangular base member. The wooden rectangular base member is positionable at a location, the plurality of horizontal members positionable in association with and partially within the wooden rectangular base member, and the wooden rectangular top member is positionable atop the plurality of horizontal members and the wooden rectangular base member.

According to another embodiment, there is provided a method of providing a wooden structural joint comprising locating a wooden rectangular base member on a surface, the wooden rectangular base member comprising a removed center element, a plurality of removed center edge elements, and four intact corner elements, where the removed center element and the at least two removed center edge elements are cut vertically into one end of the wooden rectangular base member, positioning a plurality of horizontal members in association with the wooden rectangular base member, each horizontal member having a height and having a tab cut therein at one edge of the horizontal member at a percentage of the height such that all horizontal members fit securely when assembled within the wooden rectangular base member, and locating a wooden rectangular top member having one end cut similar to the wooden rectangular base member atop the wooden rectangular base member and the plurality of horizontal members.

According to a further embodiment, there is provided a wooden structural joint comprising a wooden rectangular base member comprising, at one end, a removed center element, a plurality of removed center edge elements, and four intact corner elements, where the removed center element and the plurality of removed center edge elements are formed from vertical and horizontal cuts into the one end of the wooden rectangular base member, a plurality of horizontal members, each horizontal member having a height and further having a tab cut therein at one edge of the horizontal member, the tab cut at a percentage of the height such that all horizontal members fit securely together when assembled within the wooden rectangular base member, and a wooden rectangular top member having one end cut similar to the wooden rectangular base member.

These and other advantages of the present invention will become apparent to those skilled in the art from the following detailed description of the invention and the accompanying drawings.

BRIEF DESCRIPTION OF THE DRAWINGS

For a more complete understanding of the present disclosure, reference is now made to the following figures, wherein like reference numbers refer to similar items throughout the figures:

FIG. 11D shows possible adjustments to the base and post to achieve a true and accurate installation and alignment of interlocking beams;

FIG. 11E is a representation of an embodiment with components secured; and

DETAILED DESCRIPTION

The following description and the drawings illustrate specific embodiments sufficiently to enable those skilled in the art to practice the system and method described. Other embodiments may incorporate structural, logical, process and other changes. Examples merely typify possible variations. Individual elements and functions are generally optional unless explicitly required, and the sequence of operations may vary. Portions and features of some embodiments may be included in, or substituted for, those of others.

The present design provides a wood timber construction joint solution having a low carbon footprint that exceeds the capabilities of previous similar designs. The design allows up to four timber beams to rest simultaneously on a timber column in a way that accommodates vertical gravitational and live loads without the need for steel hangers or flanges. The design allows the timber beams to have structural contact with the vertical surface of the notched timber column. This vertical contact can be supported by a glue and/or mechanical lag screw fastening system that serves to resist lateral forces. The design is sustainably constructed using timber resources with minimal glue and mechanical steel fasteners. Further, the design can be quickly and efficiently assembled without the need for multiple trades.

Figure 1A:
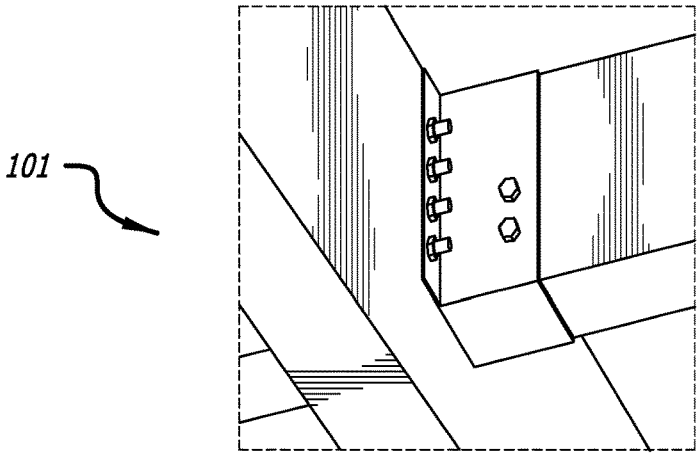
FIG. 1A (Prior Art)
FIGS. 1A, 1B, and 1C illustrate prior wood framing solutions.
Figure 1B:
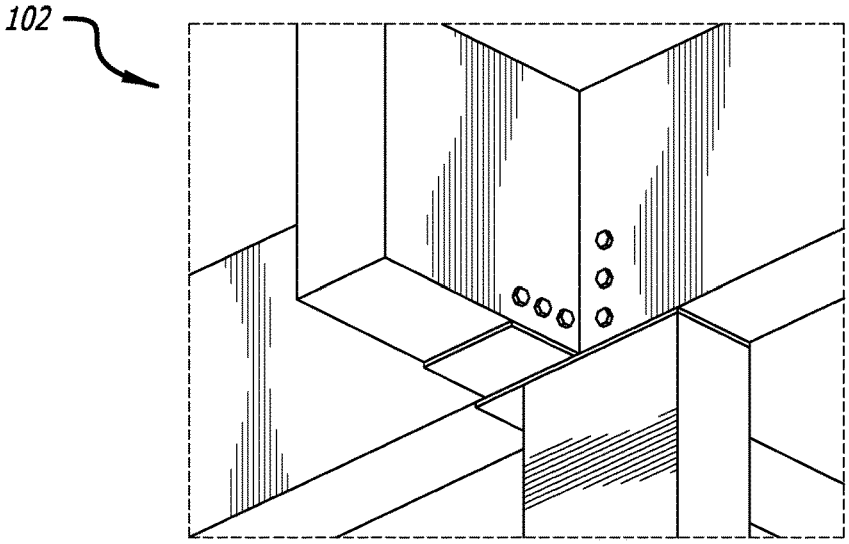
FIG. 1B (Prior Art)
Figure 1C:
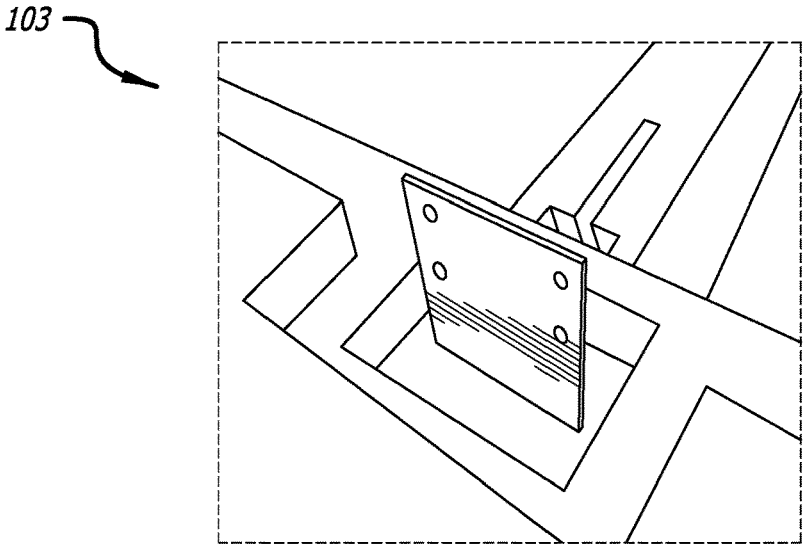
FIG. 1C (Prior Art)

FIGS. 1A, 1B, and 1C illustrate prior wood framing solutions, including metal support and/or securing elements 101, 102, and 103.

Figure 2:
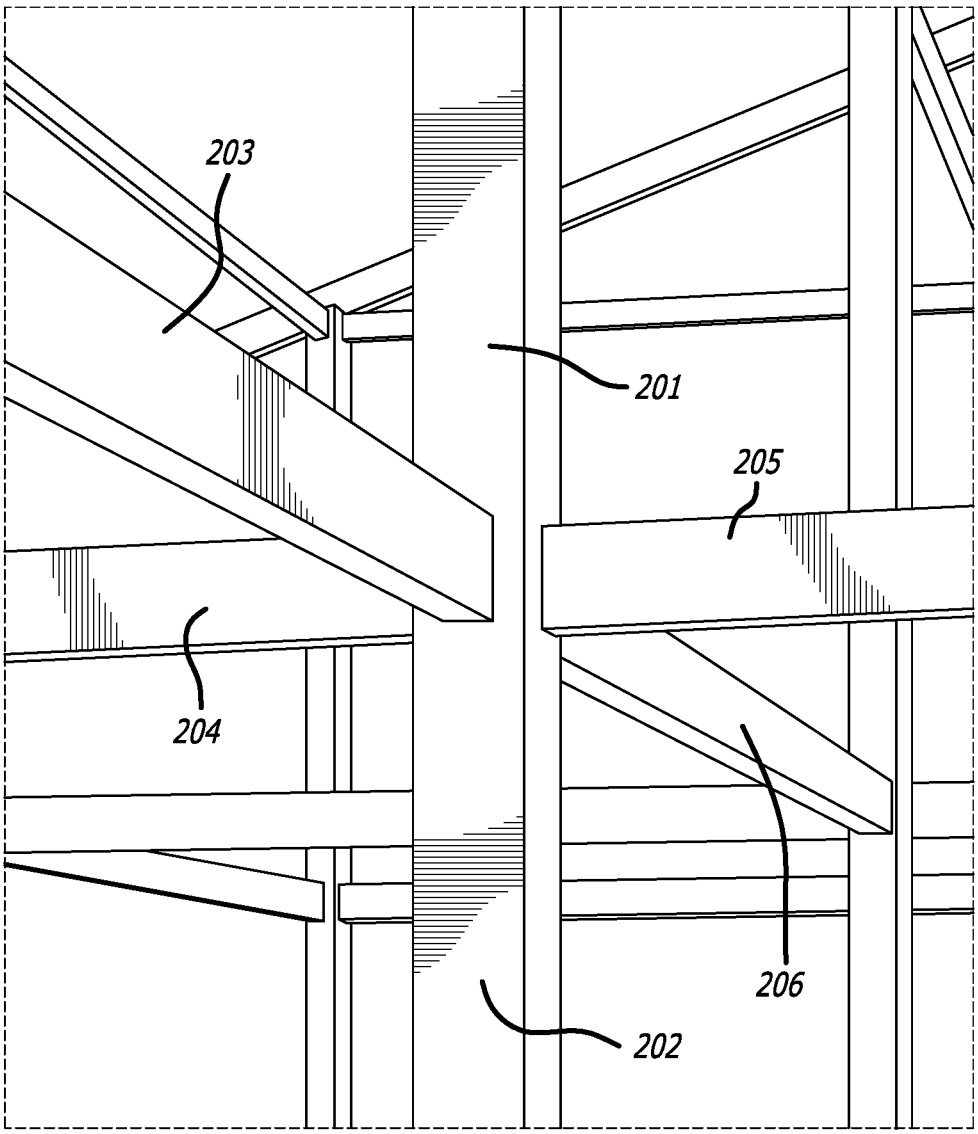
FIG. 2 shows a portion of a framed structure including upper and lower vertical beams as well as horizontal beams.

FIG. 2 shows a portion of a framed structure including upper vertical column 201 and lower vertical column 202 as well as horizontal beams 203, 204, 205, and 206. Vertical forces, typically downward forces, result from gravity and, for example, human occupation. Lateral forces such as wind, earthquakes, and other stresses may be encountered at the joint between the horizontal and vertical framing elements.

Figure 3:
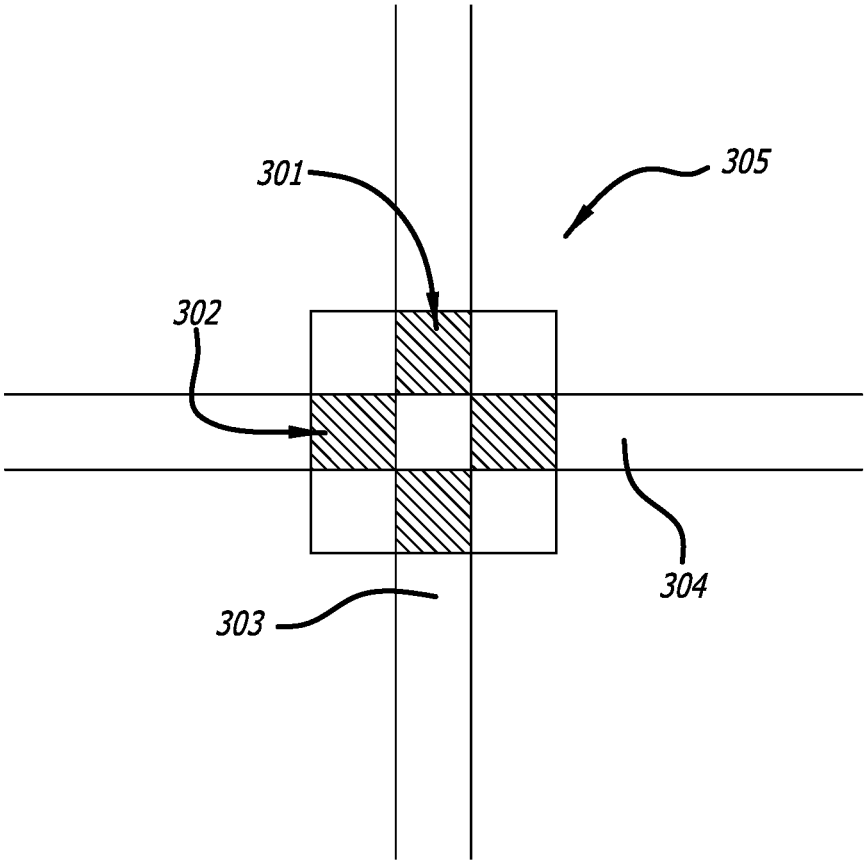
FIG. 3 is a top view of the present wood or wood timber design.
Figure 4:
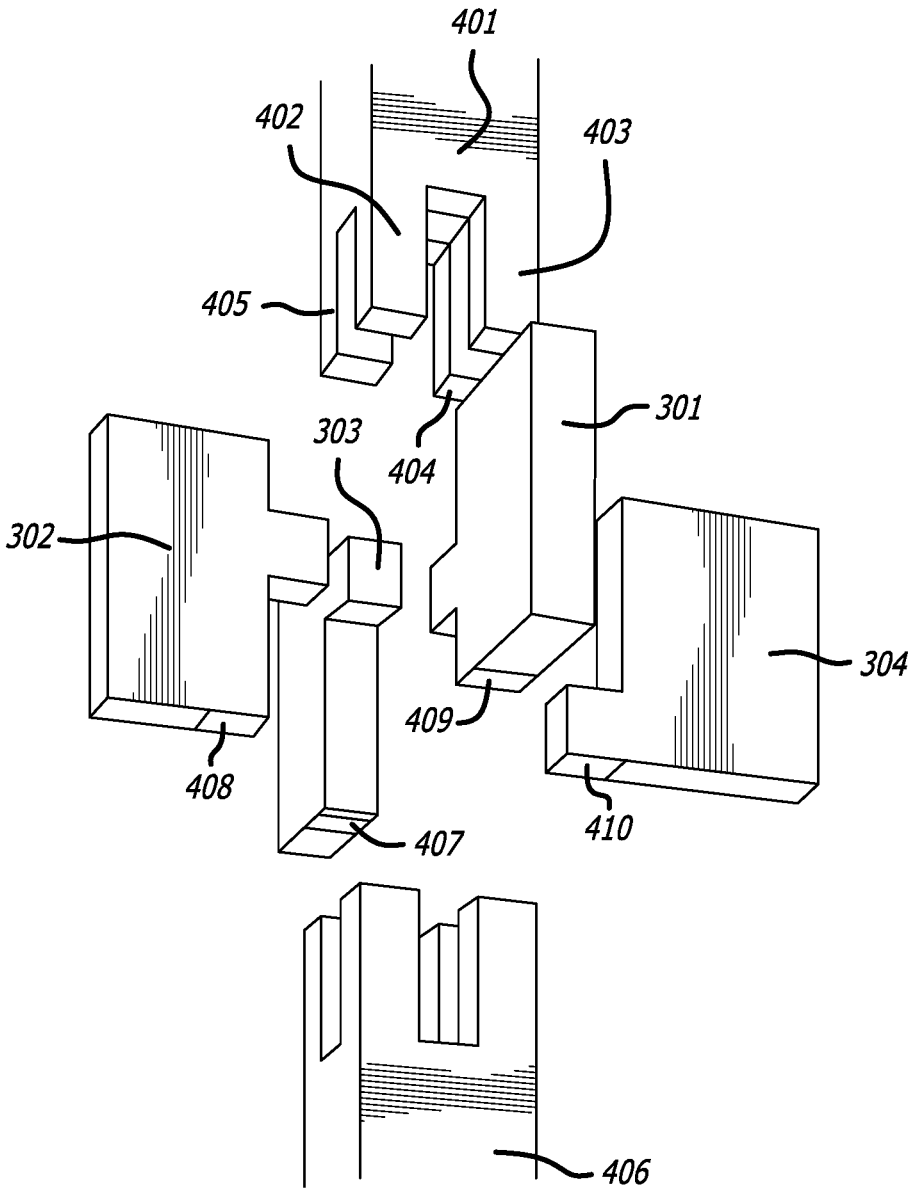
FIG. 4 illustrates a three dimensional exploded view of one embodiment of the present design.

FIG. 3 is a top view of the present wood design. From FIG. 3, load bearing surfaces 301, 302, 303, and 304 are joined at framing joint 305, with the vertical load bearing surfaces extending into framing joint 305. A three dimensional exploded view of one embodiment of the present design is represented in FIG. 4. From FIG. 4, upper column element 401 includes cuts to a single piece of wood that produce four rectangular protrusions 402-405. From the top, the resultant piece has attributes of a 3 by 3 square, with the four corners represented by rectangular protrusions 402-405, and all other openings, the four side squares and the center square, cut out to a similar depth. Note that while squares are shown, other shapes, such as rectangles, may be employed. A corresponding lower column element 406 is provided, having similar construction to the upper column element 401, including the same four rectangles and the same cutouts. The depth of cut may differ on upper column element 401 and lower column element 402, but in general they may be the same.

The horizontal support members 301, 302, 303, and 304 are cut with tabs formed thereon. In the arrangement shown, the ends of the horizontal support members include a protruding tab formed or cut therein, which may take the shape of a cube or other appropriate shape. Each horizontal member has its protruding tab provided at a different vertical position such that when all four horizontal members are positioned within lower column element 406 and upper column element 401, the tabs are aligned one atop the other, all four tabs in position above the open "center" square of the three-by-three square. The present design may include glue or another adhesive applied between the tabs to secure them, but such glue or adhesive is not required.

Figure 5:
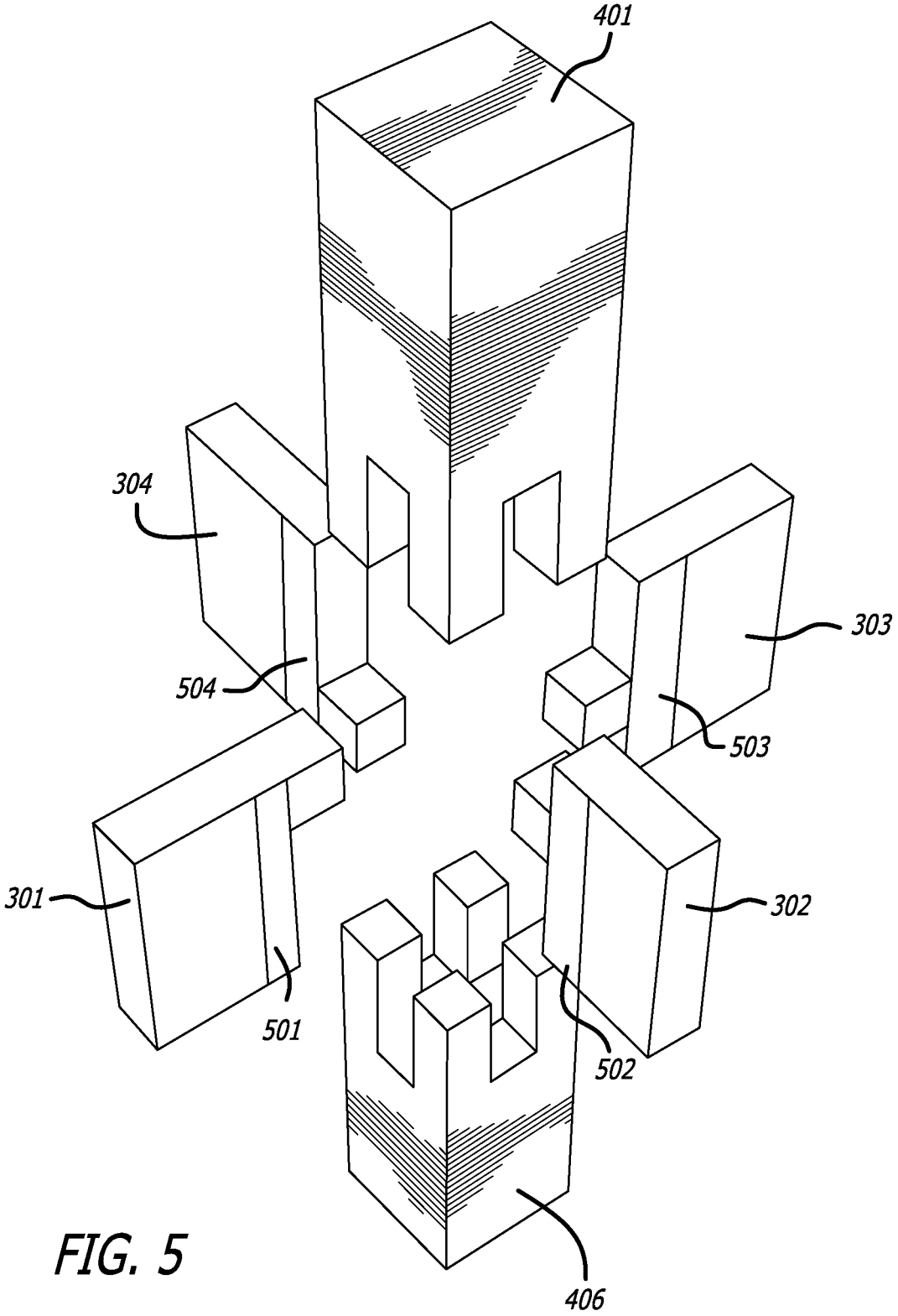
FIG. 5 shows an alternate view of the design and includes horizontal load bearing surfaces provided on both sides of each horizontal member.

Load bearing surfaces 407, 408, 409, and 410 are direct vertical load bearing surfaces. FIG. 5 shows an alternate view of the design and includes horizontal load bearing surfaces 501, 502, 503, and 504, but horizontal load bearing surfaces are provided on both sides of each horizontal member, not only the side shown in this view. Once the four horizontal members have been inserted and secured, upper column element 401 may be placed atop lower element 406 and the secured horizontal support members 301, 302, 303, and 304. The upper element 401 may be secured to the lower element and one or more of the horizontal support members using glue or other adhesive, but again this is not mandatory in all situations. Further construction may then proceed.

The inherent arrangement of all elements in a precise vertical and horizontal geometric alignment is a notable feature of the joint design. In prior timber framing solutions, maintaining vertical and horizontal precision in the construction process has been accomplished through intermittent manual leveling and corrective adjustment of individual members. The current design provides for continuous alignment of the total system of elements as a result of the inherently continuous and precise geometric alignment of all horizontal and vertical elements.

The pieces identified are fabricated from wood and cuts may be made using CNC computer driven routing machines that provide precise and structurally efficient pieces for assembly. Again, regarding sizing, the openings formed when upper element 401 and lower element 406 are joined are sufficient to accommodate the horizontal support members. For example, a 2 by 8 inch horizontal member may have actual dimensions of 1½ by 7¼ inches, and the opening formed when upper element 401 and lower element 406 are joined may be 1½ inches wide with a 7¼ inch opening formed, such as a depth of 3 and ⅝ inches cut into each of the lower element and upper element. In this example, a shift of dimensions may be provided, such as lower element 406 having 4 inches of depth cut therein and upper element 401 having 3¼ inch of depth cut therein. Of course, any reasonably sized horizontal members may be accommodated.

Figure 6C:
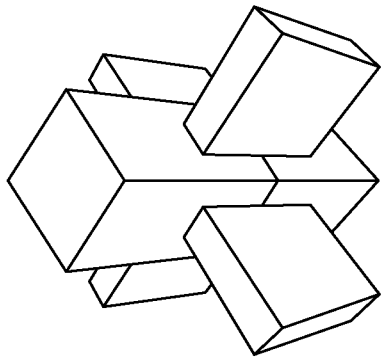
FIG. 6C is the arrangement in a completed, finished form.
Figure 6B:
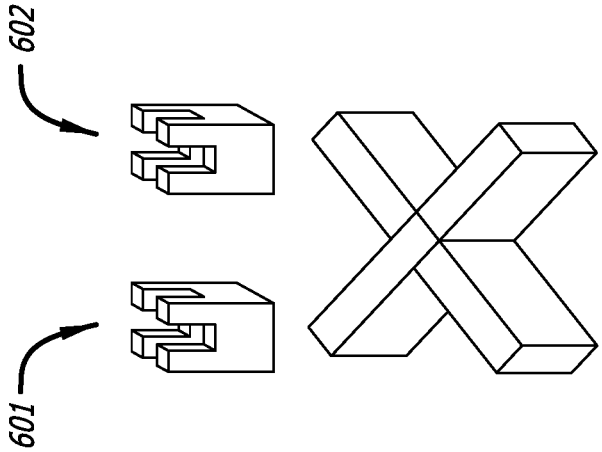
FIG. 6B shows the horizontal members connected.
Figure 6A:
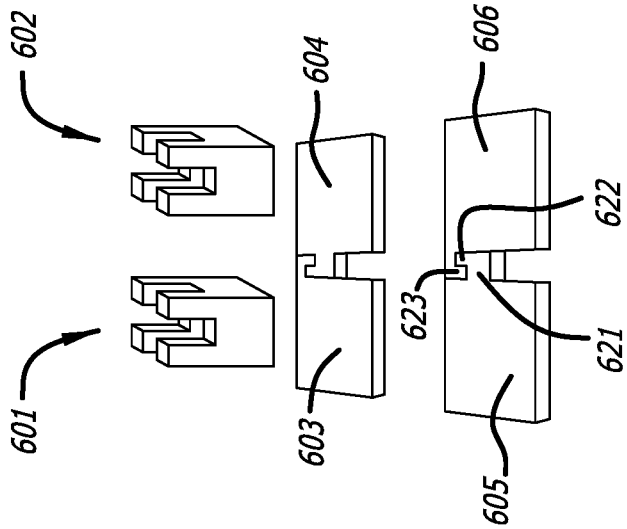
FIG. 6A is a first alternate arrangement having two identical column connections and two pairs of partial horizontal support members.
Figure 6D:
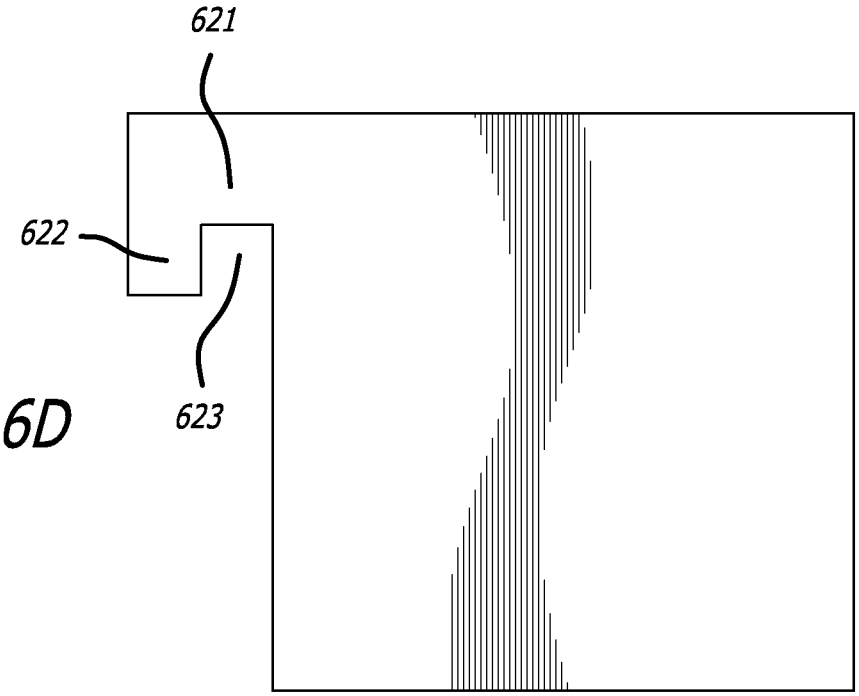
FIG. 6D illustrates a portion of one horizontal member used in the embodiments shown in FIGS. 6A through 6C.

Further notches, pins, tabs, or other attributes may be provided. FIG. 6A illustrates a first alternate arrangement having two identical column connections 601 and 602, shown here as partial components for illustrative purposes, and two pairs of partial horizontal support members, again shown for illustrative purposes. In this view, the two pairs of partial horizontal members including partial horizontal members 603, 604, 605, and 606 each include both a main tab and a smaller protrusion and receiving slot, also known as interlocking portions. FIG. 6A shows one partial horizontal member including main tab 621, smaller protrusion 622, and receiving slot 623 in which the corresponding smaller protrusion on the adjacent horizontal member is positioned. In this arrangement, facing or aligned horizontal support members have smaller protrusions and receiving slots that align such that one aligned pair, such as partial horizontal members 603 and 604, can be positioned below the other aligned pair, such as partial horizontal members 605 and 606. Fabrication and installation in this manner can provide additional interlocking attributes and relative ease of installation. FIG. 6B shows the horizontal members of this embodiment assembled. FIG. 6C shows the design fully assembled, including column connections 601 and 602. FIG. 6D shows one of the horizontal members employed, including main tab 621, smaller protrusion 622, and receiving slot 623. In this arrangement, facing or aligned horizontal support members have smaller protrusions and receiving slots that align such that one aligned pair, such as partial horizontal members 603 and 604, can be positioned below the other aligned pair, such as partial horizontal members 605 and 606. Fabrication and installation in this manner can provide beneficial interlocking attributes.

Figure 7D:
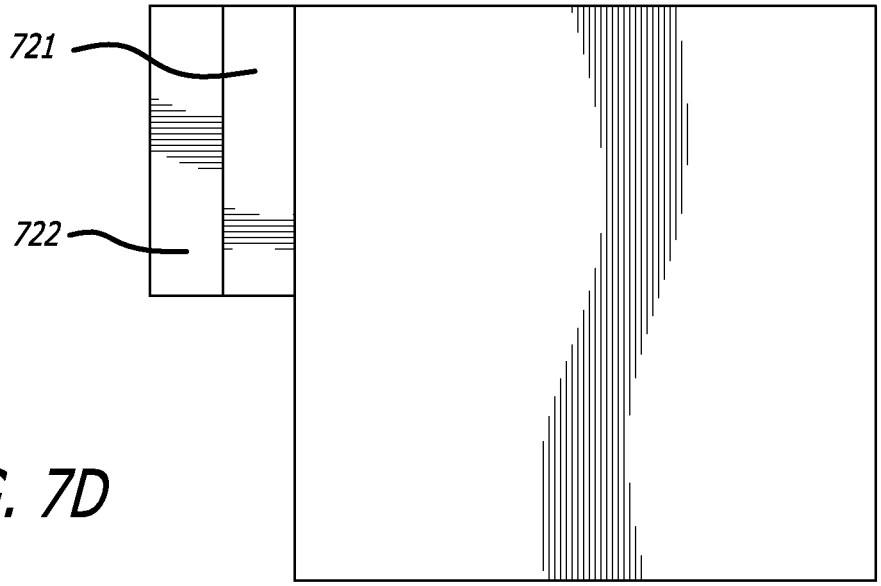
FIG. 7D is a portion of one horizontal member used in the embodiments shown in FIGS. 7A through 7C.
Figure 7C:
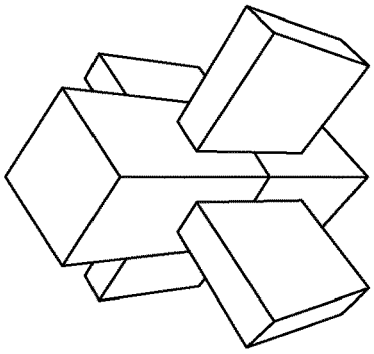
FIG. 7C shows the two pair of partial horizontal members joined together between the upper and lower column connections.
Figure 7B:
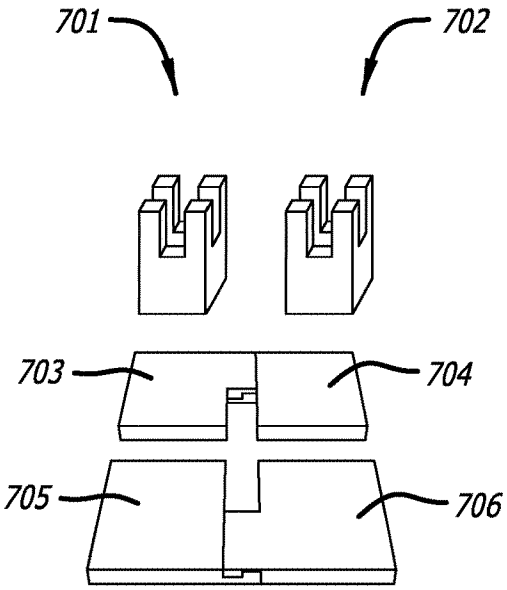
FIG. 7B illustrates the two pair of partial horizontal members joined together.
Figure 7A:
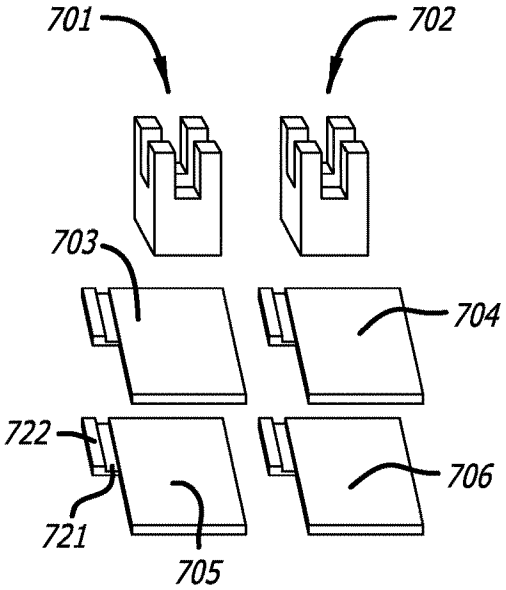
FIG. 7A illustrates a second alternate arrangement, again having two identical column connections.

FIG. 7A illustrates a second alternate arrangement, again having two identical column connections 701 and 702, shown as partial components for illustrative purposes. Two pairs of partial horizontal support members are shown, 703, 704, 705, and 706, again for illustrative purposes. The two pairs of partial horizontal members 703, 704, 705, and 706 each include both an extension element and a remote tab, creating a receiving slot for the facing or aligned partial horizontal member. FIG. 7B shows the two pair of partial horizontal members joined together between the upper and lower column connections, while FIG. 7C shows the two pair of partial horizontal members joined together between the upper and lower column connections. FIG. 7D shows a portion of one horizontal member in accordance with this embodiment, including extension element 721 and remote tab 722. Extension element 721 and remote tab 722 may extend approximately halfway up the partial horizontal member. In this arrangement, facing or aligned horizontal support members can fit together and the perpendicular members can be fitted in the notch or hole so formed.

Figure 8C:
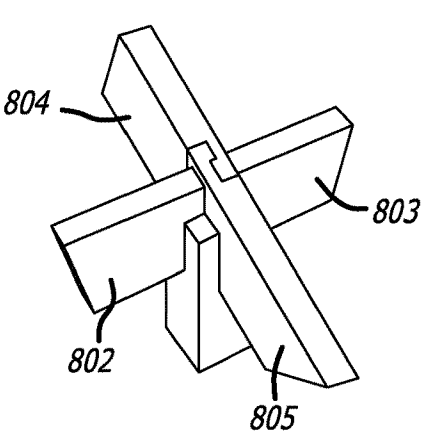
FIG. 8C shows the joint assembled.
Figure 8B:
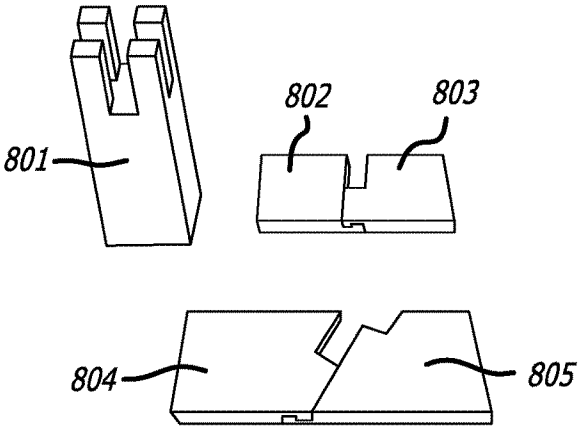
FIG. 8B shows the two pairs of members joined together and ready for assembly.
Figure 8A:
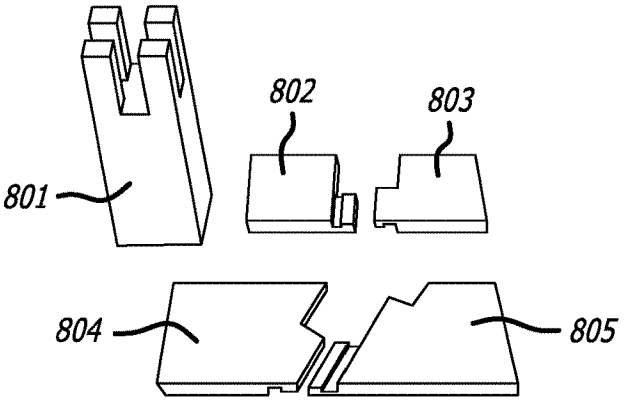
FIG. 8A shows a third alternate arrangement, employing a slanted set of partial horizontal members.

FIG. 8A shows a third alternate arrangement, employing a slanted set of partial horizontal members. When assembled, as shown in FIG. 8C, members 802 and 803 are typically horizontal, while cross members 804 and 805 are provided at an angle, such as 45 degrees. In this view, and as shown in FIG. 8A, a single column connection 801 is provided, but a second column connection may be provided and may be used to secure the cross members. Elements or members 802 and 803 may be constructed in a manner similar to the partial cross members of FIG. 7. Cross members 804 and 805 are constructed such that the notch formed when the pieces are joined match with the notch formed by joined members 802 and 803. FIG. 8B shows the two pairs of members joined together and ready for assembly. As may be appreciated, various nonzero and non-90 degree angles may be employed in this arrangement.

Figure 9A:
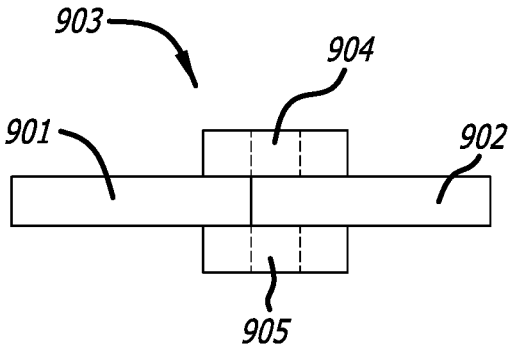
FIG. 9A shows a top view of the joint where horizontal members are shown in place in the base joint element.

The result is a solid timber joint that obviates the need for metal support pieces and/or screws, one that can be easily assembled by a single trade. Other arrangements can be provided. For example, in the representation of FIG. 5, a corner joint may be offered, where a corner joint is one where two perpendicular cross pieces are provided. In such an arrangement, two perpendicular sides of the support members may include openings while the other two do not. In one embodiment, each of the four sides includes an opening. Plugs, essentially short horizontal members, are provided, installed, and or secured to complete the interconnection. FIG. 9A shows a top view of the joint where horizontal members 901 and 902 are shown in place in base joint element 903, and in the conceptual 3 by 3 grid viewed from above only has three squares, with either the center and the two outside squares removed or a plug or plugs installed. Conceptual squares 904 and 905, square in this embodiment, are not removed and remain solid wood as do the four corner squares, and alternately, plugs may be employed. Note that in one embodiment, squares may be removed and selected appropriate squares replaced with wooden plugs, in this FIG.

9A arrangement as well as others shown herein. FIG. 9A shows the cutting of the horizontal members, including the forming of two tabs on the ends, here each approximately 50 percent of the height, but height of such tabs can differ. Again, a conforming top element, not shown in this view, can be provided once the horizontal members have been installed and possibly secured by glue or other appropriate substance.

Figure 9B:
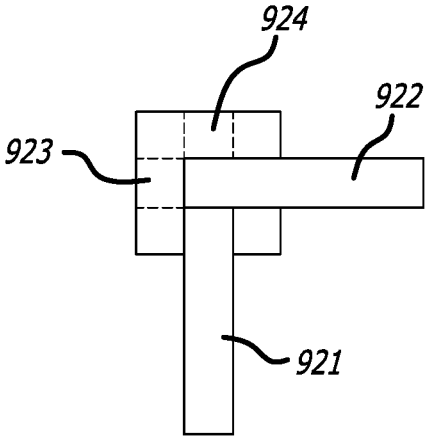
FIG. 9B shows an arrangement with two horizontal members provided perpendicularly.

FIG. 9B shows an arrangement with two horizontal members 921 and 922 provided perpendicularly. The same tabs shown used in the horizontal members of FIG. 9A, each representing 50 percent of the height of the horizontal member 921 or 922 in this embodiment, may be employed. The base joint element may be cut as shown, with perpendicular openings cut into the base joint element, and side edge pieces 923 and 924 left intact or uncut from the base or plugs may be provided. Again, a corresponding top element may be employed, not shown in this view. And according to an alternate embodiment, squares may be removed and selected appropriate squares replaced with wooden plugs, in this FIG. 9A arrangement as well as others shown herein.

Figure 9C:
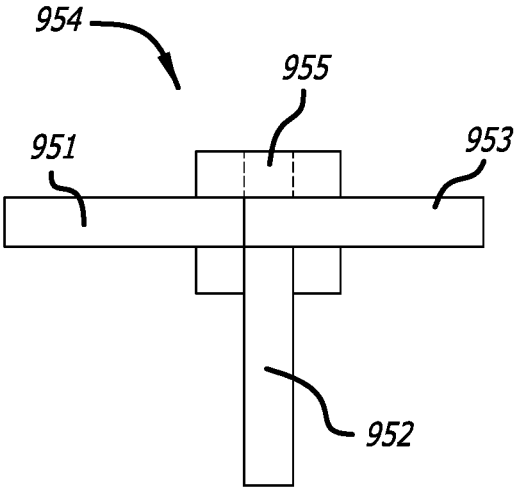
FIG. 9C illustrates a design with three horizontal members joined at a base joint element.

FIG. 9C illustrates a design with three horizontal members, 951, 952, and 953, joined at base joint element 954. The portions of the base joint element cut include the center and the three outer areas in the conceptual three by three grid such that the base joint element accommodates the horizontal members, where in one embodiment wooden plugs may be provided in existing empty squares or holes. Conceptual three by three grid square 955 is the sole edge square or edge element not removed. The three horizontal members each include, in this embodiment, a tab or protrusion covering approximately one third the height of the horizontal member. The horizontal member with the bottom most tab, horizontal member 951, may be inserted or located in the base joint element 954 first, the horizontal member with the center tab, horizontal member 952, inserted second, and the horizontal member with the top most tab, horizontal member 953, inserted last. Glue or adhesive may be applied where desired, including between tabs and at the top or bottom of the arrangement. A top covering joint element corresponding to the base joint element may be provided, again not shown in this view.

The present design may additionally include a method of installing framing using the design presented above. Installers may position a base with associated hardware and initially position or connect a post, or multiple posts and possibly beams or horizontal members. Installers initially connect, but do not lock, each post and beam at the installed or positioned base and then connect, but do not lock, posts and beams at the top of the structure. This design may employ a multi-directional steel base at the foundation of each post which allows small adjustments to each post to provide precise orientations. Bases are provided such that they can be translated or rotated by small amounts prior to fixing them to the floor or other surface, such as a foundation. By small amount, this may mean fractions of inches or fractions of degrees of rotation. Once positioned, installers may then lock or secure each connection in place starting at the top of each post and beam frame on the first floor, and then at each base. For each subsequent floor or post attached, installers repeat the process of adjusting and truing up or verifying the correct position of the component, typically from the top down, first locking the top of the frame or post and then the bottom.

Figure 10A:
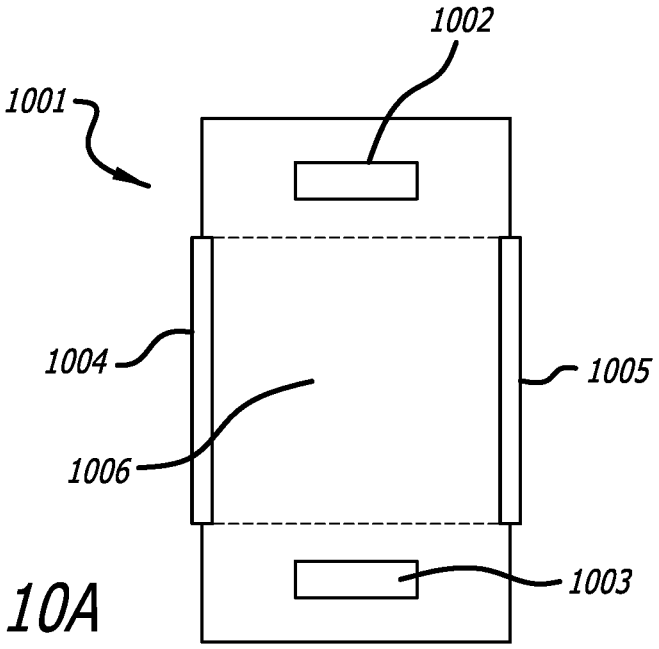
FIG. 10A illustrates an embodiment of a base used with the present design.
Figure 10B:
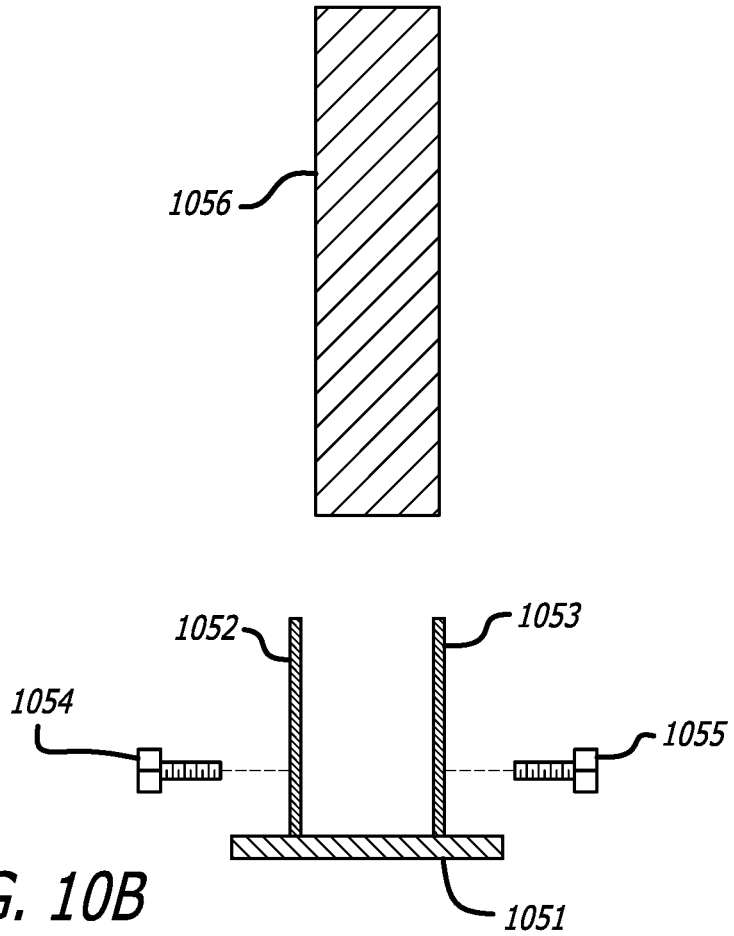
FIG. 10B is a side view of an arrangement used in accordance with the present design including a post, support members, and a base.

FIG. 10A shows a representation of one embodiment of a base that may be used in this design. Base 1001 includes openings 1002 and 1003 as well as support elements 1004 and 1005. As noted, the base can move, typically laterally in this view or by rotation, while the post can move vertically in this view, i.e. up and down, to provide an accurate and stable base. The post, or the bottom element of the construction discussed above, can be positioned in position 1006. FIG. 10B illustrates a side view of the FIG. 10A representation, including barrier 1051, support elements 1052 and 1053, and caps 1054 and 1055. Barrier 1051 may be a base such as base 1001, and/or a termite barrier, for example. Caps 1054 and 1055 are typically installed to cover bolt heads or other hardware used to secure the base or barrier to the floor or foundation. In this view, installers may lower or position post 1056 between support elements 1052 and 1053 and may perform the adjustments described. In one embodiment, the base may be secured to the foundation, such as by using bolts, before the post is installed when, for example, bolt holes or anchor holes are under the post when installed.

Figure 11A:
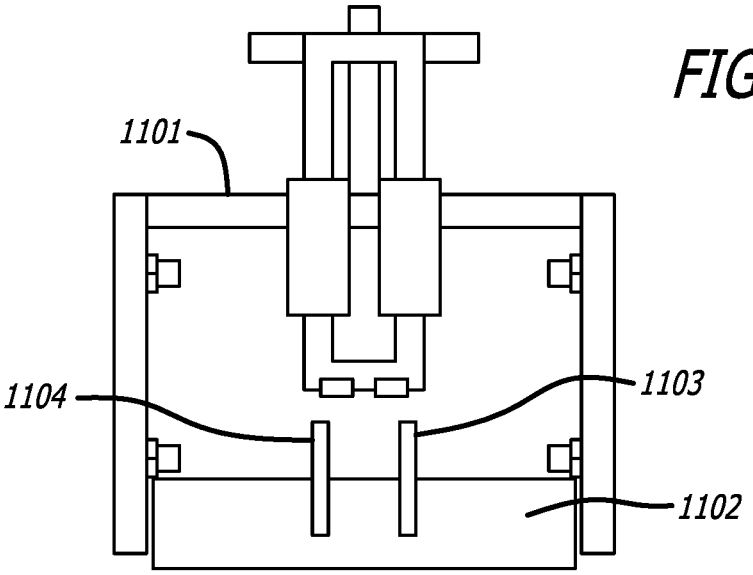
FIG. 11A is a view of an apparatus used to identify the proper position of anchor bolts when, for example, wet-setting in a foundation.
Figure 11B:
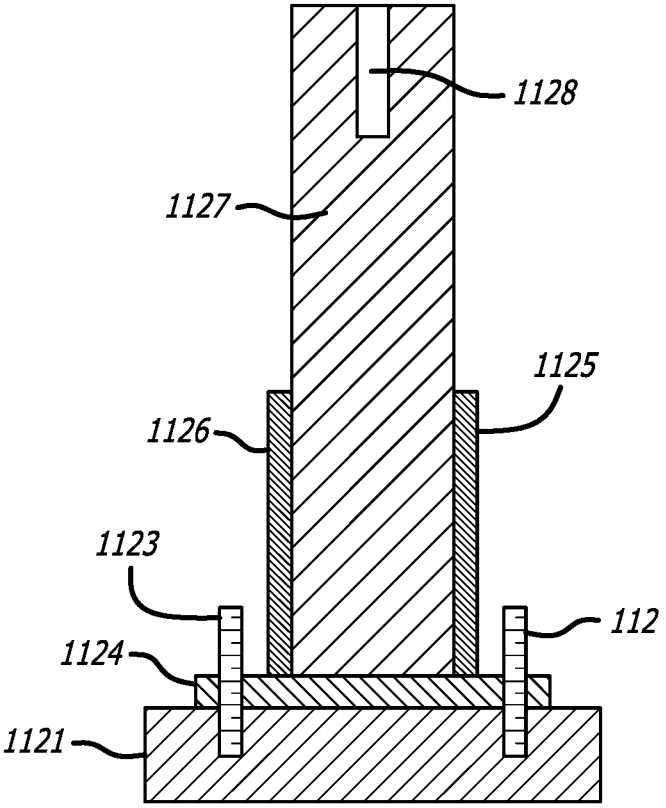
FIG. 11B shows placing, not locking, components of the design.
Figure 11C:
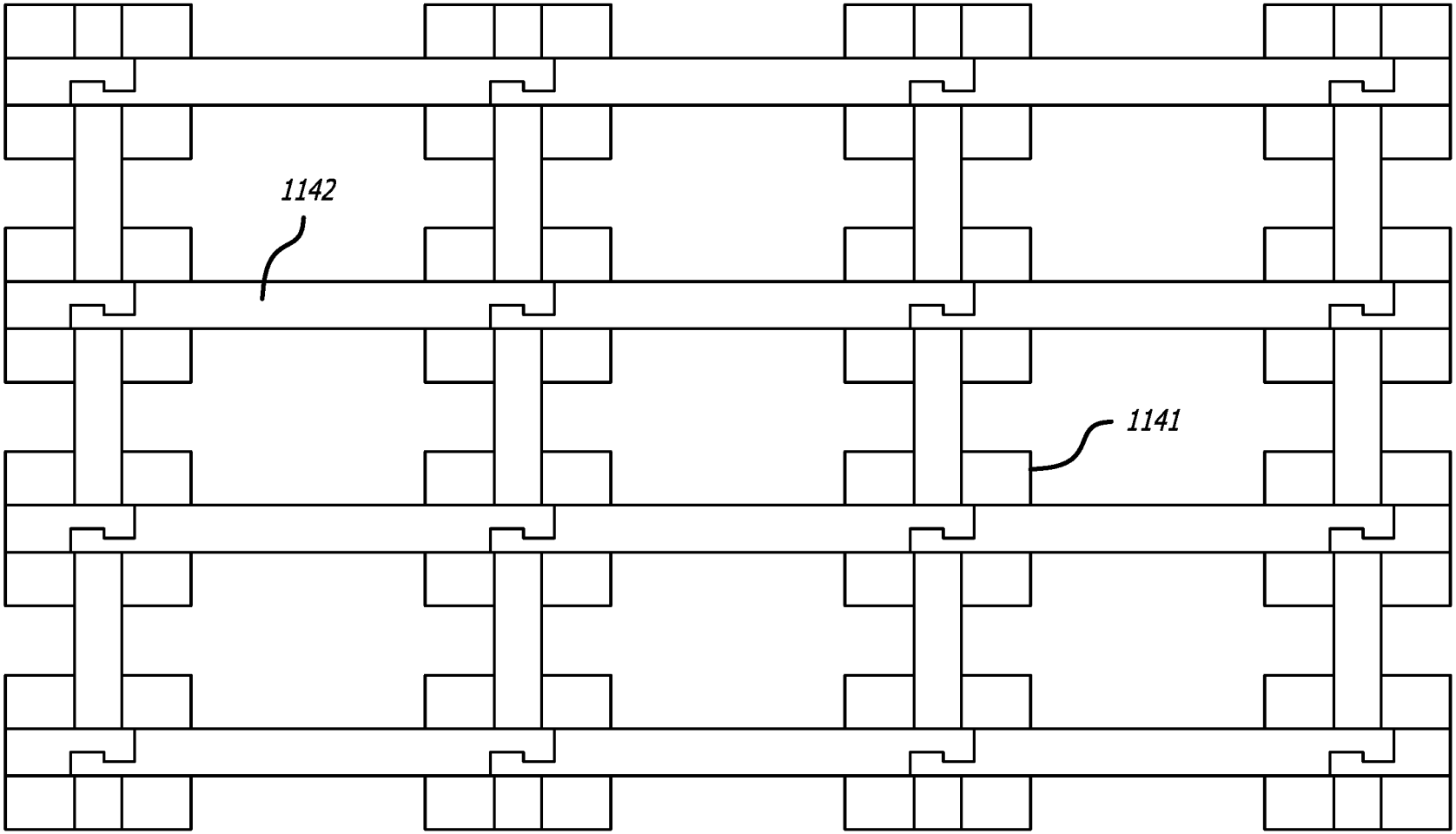
FIG. 11C illustrates the installation of interlocking beams, again with the elements placed, but not locked or secured, in place.

FIG. 11A illustrates an example of the present design. In FIG. 11A, installation personnel place location apparatus 1101 over the foundation and depress location apparatus 1101 to identify a location where anchor bolts 1102 and 1103 can be either wet-set or cast in place in, for example, a foundation 1102. FIG. 11B illustrates initial placement, but not securing, of components, with foundation 1121, bolts 1122 and 1123, base 1124, support members 1125 and 1126, and post 1127. Again, these components, with the exception of bolts 1122 and 1123 and foundation 1121, are positioned but not secured or locked. Installers may install or position multiple posts in this manner FIG. 11C is a conceptual, not to scale, representation of multiple posts and interlocking beams, where such beams are installed after the posts have positioned. Shown in this representation are, for example, post 1141 and beam 1142. In one embodiment, all posts and support beams are installed without any component being locked or secured to ensure fit. FIG. 11D represents making adjustments to one base and post, wherein base 1161 has support members 1162 and 1163 attached in one embodiment, where post 1164 is positioned and bolts 1165 and 1166 are shown. Bolts and holes may vary in size. In this representation and orientation, the post 1164 may move be repositioned up and down, while base 1161 may be rotated or may translate left and right to properly position the post relative to all other posts in view of the supporting members provided. FIG. 11E illustrates securing of the post and components, with securing elements 1181, 1182, 1183, and 1184 provided through support elements 1185 and 1186 and securing post 1187. Caps or securing elements 1188 and 1189 are also shown. Other orientations and components may be provided.

In this method, the post represented in the drawings of FIGS. 10A and B and 11A through 11D are simplified versions and not to scale. In FIG. 11B, for example, an opening 1128 is shown that represents an opening wherein a horizontal beam may be inserted. It is to be understood that while any post may be employed, the post construction presented above is one embodiment that may be employed including cross members or horizontal beams, the conceptual three by three or nine square arrangement, and the cross members or horizontal beams provided as shown.

Figure 12:
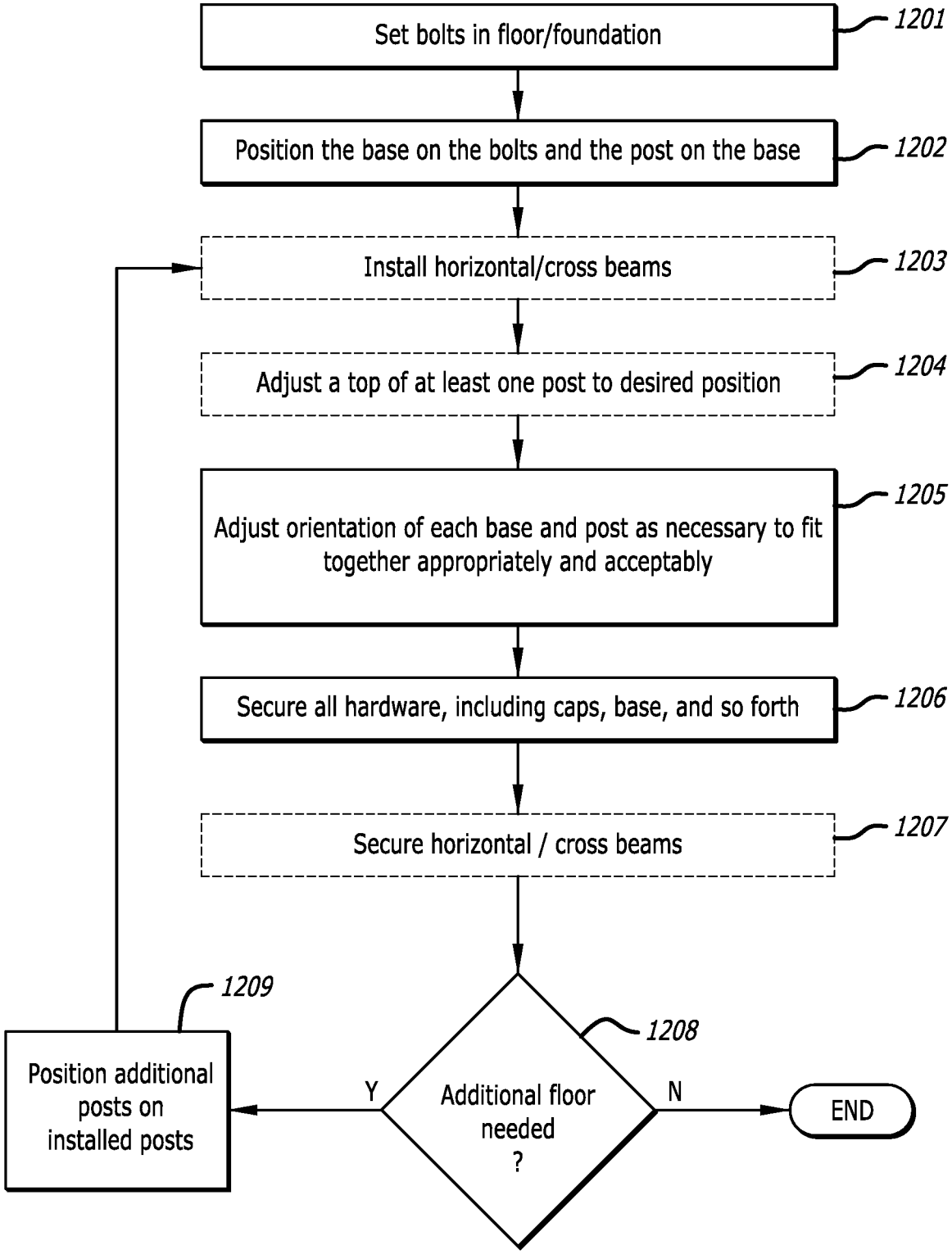
FIG. 12 is a flowchart according to one embodiment of the design.

FIG. 12 is a general flowchart of operation according to the present design. At point 1201, an installer may set bolts in the floor or foundation. Point 1202 calls for positioning the base on the bolts and the post on the base, which may be performed for multiple bases and posts. Point 1203 is optional and seeks to install the interlocking beams, and as noted, in one embodiment all horizontal or cross beams are installed, establishing a clear post and beam arrangement such that parts can be locked down with confidence. Point 1204 is also optional and calls for adjustment of a top of at least one post to a desired position. Point 1204 may be performed when, for example, cross beams are not available, but measurements of the cross beams are known. Point 1205 seeks to adjust the posts and the beams when installed, and point 1206 calls for adjusting the orientation of the base and post as necessary to fit appropriately. Point 1207 calls for securing the horizontal or cross beams when employed, where securing may include application of screws, bolts, or other connecting hardware between the cross beams and possibly between at least one cross beam and a post. Point 1208 evaluates whether all posts and cross beams have been installed, i.e. if a further floor is contemplated. If a further floor is required, no securing to the foundation or floor is required, but additional posts may be provided on installed posts and any connecting elements or components may be installed at point 1209, including flooring elements, and the method returns to point 1203. If no additional floors are contemplated, the frame installation process is complete. Thus point 1202, while contemplating a base, bolts, and support elements, on higher floors may include different hardware to enable setting the post and/or post elements, cross beams, and so forth, with truing up or setting the posts and beams before locking or securing them.

Thus in general, in some embodiments, the present design may include a wood or wood timber construction comprising two to four horizontal members and two base members, the base members cut to accommodate the horizontal members. The base members in one embodiment may be considered to be a conceptual three by three element grid, with the center element cut out and side (non-corner) elements removed to accommodate the necessary number of horizontal members. The horizontal members may include tabs or protrusions a portion of the height of the horizontal member, such as 50 percent of the height when two horizontal members are employed, 25 percent when four are employed, and so forth, but heights may differ from these values. In practice, the bottom base member may be positioned, and the horizontal members inserted such that the tabs are positioned over the removed element of the conceptual three by three element grid. Adhesive or glue may be provided. The bottom most tab on the first horizontal member may be placed first with the bottom tab proximate or adjacent to the bottom base member, followed by the next vertical tab, until all horizontal members have been placed. At this point, the accommodating top base member, cut similar to the bottom base member, may be placed thereon, securing the joint. Different accommodations for diagonally oriented members may be provided as shown herein.

Different constructions may be employed as discussed herein. For example, and not by way of limitation, different dimension horizontal members may be employed, requiring different cuts in the base and top members. The result in the three by three configuration is that cross sections to the corner pieces may be rectangular in shape rather than square in shape. Further, the base and top elements may be rectangular in shape, for example. However, the fabrication and use of tabs or protrusions and the forming of base and top members as suggested herein are typically employed. Further, while primarily directed herein to wood members, other members may be employed while within the scope of these teachings, including 3D printed elements, polymers, metal or partial metal pieces, multiple components in a single joint made of different materials, and so forth.

Thus according to one embodiment, there is provided a wooden structural joint comprising a wooden rectangular base member comprising a removed center element, a plurality of removed center edge elements, and four intact corner elements, where the removed center element and the at least two removed center edge elements are formed by cutting vertically and horizontally into one end of the wooden rectangular base member, a plurality of horizontal members, each horizontal member having a height and a tab cut therein at one edge of the horizontal member, the tab cut at a percentage of the height such that all horizontal members fit together securely when assembled within the wooden rectangular base member, and a wooden rectangular top member having one end cut similar to the wooden rectangular base member. The wooden rectangular base member is positionable at a location, the plurality of horizontal members positionable in association with and partially within the wooden rectangular base member, and the wooden rectangular top member is positionable atop the plurality of horizontal members and the wooden rectangular base member.

According to another embodiment, there is provided a method of providing a wooden structural joint comprising locating a wooden rectangular base member on a surface, the wooden rectangular base member comprising a removed center element, a plurality of removed center edge elements, and four intact corner elements, where the removed center element and the at least two removed center edge elements are cut vertically into one end of the wooden rectangular base member, positioning a plurality of horizontal members in association with the wooden rectangular base member, each horizontal member having a height and having a tab cut therein at one edge of the horizontal member at a percentage of the height such that all horizontal members fit securely when assembled within the wooden rectangular base member, and locating a wooden rectangular top member having one end cut similar to the wooden rectangular base member atop the wooden rectangular base member and the plurality of horizontal members.

According to a further embodiment, there is provided a wooden structural joint comprising a wooden rectangular base member comprising, at one end, a removed center element, a plurality of removed center edge elements, and four intact corner elements, where the removed center element and the plurality of removed center edge elements are formed from vertical and horizontal cuts into the one end of the wooden rectangular base member, a plurality of horizontal members, each horizontal member having a height and further having a tab cut therein at one edge of the horizontal member, the tab cut at a percentage of the height such that all horizontal members fit securely together when assembled within the wooden rectangular base member, and a wooden rectangular top member having one end cut similar to the wooden rectangular base member.

The foregoing description of specific embodiments reveals the general nature of the disclosure sufficiently that others can, by applying current knowledge, readily modify and/or adapt the system and method for various applications without departing from the general concept. Therefore, such adaptations and modifications are within the meaning and range of equivalents of the disclosed embodiments. The phraseology or terminology employed herein is for the purpose of description and not of limitation.

What is claimed is:

1. A wooden structural joint, comprising:

a wooden rectangular base member comprising a removed center element, a plurality of removed center edge elements, and four intact corner elements, where the removed center element and the at least two removed center edge elements are formed by cutting vertically and horizontally into one end of the wooden rectangular base member;

a plurality of horizontal members, each horizontal member having a tab cut therein at one edge of the horizontal member, each tab cut in each horizontal member at a different orientation than at least one other tab in at least one other horizontal member, each tab cut such that all horizontal members fit together securely when assembled within the wooden rectangular base member; and a wooden rectangular top member having one end cut similar to the wooden rectangular base member;

wherein the wooden rectangular base member is positionable at a location, the plurality of horizontal members positionable in association with and partially within the wooden rectangular base member such that each horizontal member is in contact with at least one other horizontal member, and the wooden rectangular top member is positionable atop the plurality of horizontal members and the wooden rectangular base member.

2. The wooden structural joint of claim 1, wherein the horizontal members are formed of wood.

3. The wooden structural joint of claim 1, wherein each of the four intact corner elements has a square cross section.

4. The wooden structural joint of claim 1, wherein four horizontal members are provided, and four removed center edge elements are cut from the wooden rectangular bottom member and the wooden rectangular top member.

5. The wooden structural joint of claim 1, wherein adhesive or glue is applied within the wooden structural joint.

6. The wooden structural joint of claim 1, wherein tabs are of identical height for all horizontal members.

7. The wooden structural joint of claim 1, wherein tabs differ in height between at least two horizontal members.

8. The wooden structural joint of claim 1, wherein each tab includes an interlocking portion formed thereon such that two tabs and interlocking portions fit securely together.

9. A method of providing a wooden structural joint, comprising:

locating a wooden rectangular base member on a surface, the wooden rectangular base member comprising a removed center element, a plurality of removed center edge elements, and four intact corner elements, where the removed center element and the at least two removed center edge elements are cut vertically into one end of the wooden rectangular base member;

positioning a plurality of horizontal members in association with the wooden rectangular base member, each horizontal member having a tab cut therein at one edge of the horizontal member such that all horizontal members fit securely when assembled within the wooden rectangular base member, each tab cut in each horizontal member at a different orientation than at least one other tab in at least one other horizontal member; and locating a wooden rectangular top member having one end cut similar to the wooden rectangular base member atop the wooden rectangular base member and the plurality of horizontal members such that each horizontal member is in contact with at least one other horizontal member.

10. The method of claim 9, wherein the horizontal members are formed of wood.

11. The method of claim 9, wherein each of the four intact corner elements has a square cross section.

12. The method of claim 9, wherein four horizontal members are provided, and four removed center edge elements are cut from the wooden rectangular bottom member and the wooden rectangular top member.

13. The method of claim 9, wherein adhesive or glue is applied within the wooden structural joint.

14. The method of claim 9, wherein tabs are of identical height for all horizontal members.

15. The method of claim 9, wherein tabs differ in height between at least two horizontal members.

16. A wooden structural joint, comprising:

a wooden rectangular base member comprising, at one end, a removed center element, a plurality of removed center edge elements, and four intact corner elements, where the removed center element and the plurality of removed center edge elements are formed from vertical and horizontal cuts into the one end of the wooden rectangular base member;

a plurality of horizontal members, each horizontal member having a height and further having a tab cut therein at one edge of the horizontal member, each tab cut in each horizontal member at a different orientation than at least one other tab in at least one other horizontal member, the tab cut such that all horizontal members fit securely together when assembled within the wooden rectangular base member; and a wooden rectangular top member having one end cut similar to the wooden rectangular base member;

wherein each of the plurality of horizontal members is positionable in association with and partially within the wooden rectangular base member such that each horizontal member contacts at least one other horizontal member.

17. The wooden structural joint of claim 16, wherein the horizontal members are formed of wood.

18. The wooden structural joint of claim 16, wherein four horizontal members are provided, and four removed center edge elements are cut from the wooden rectangular bottom member and the wooden rectangular top member.

19. The wooden structural joint of claim 16, wherein adhesive or glue is applied within the wooden structural joint.

20. The wooden structural joint of claim 16, wherein tabs are of identical height for all horizontal members.

* * * * *